US009234311B2

(12) United States Patent
Huang et al.

(10) Patent No.: US 9,234,311 B2
(45) Date of Patent: Jan. 12, 2016

(54) FLUORINE-FREE WATER REPELLENT, PREPARATION THEREOF, AND APPLICATIONS THEREOF

(71) Applicant: JINTEX CORPORATION LTD., Taipei (TW)

(72) Inventors: Pei-Yuan Huang, Taipei (TW); Yee-Fung Lin, Taipei (TW); Chien-Hung Hsu, Taoyuan (TW); Long-Chun Chu, Taipei (TW)

(73) Assignee: JINTEX CORPORATION LTD., Taipei (TW)

( * ) Notice: Subject to any disclaimer, the term of this patent is extended or adjusted under 35 U.S.C. 154(b) by 0 days.

(21) Appl. No.: 14/459,679

(22) Filed: Aug. 14, 2014

(65) Prior Publication Data

US 2015/0204010 A1 Jul. 23, 2015

(30) Foreign Application Priority Data

Jan. 20, 2014 (TW) ..... 103101937 A

(51) Int. Cl.
*D06M 15/263* (2006.01)
*D06M 15/356* (2006.01)

(52) U.S. Cl.
CPC ..... *D06M 15/263* (2013.01); *D06M 15/3568* (2013.01); *D06M 2200/12* (2013.01)

(58) Field of Classification Search
None
See application file for complete search history.

(56) References Cited

U.S. PATENT DOCUMENTS

| | | | | |
|---|---|---|---|---|
| 3,281,318 | A * | 10/1966 | Stutz | 514/737 |
| 3,486,911 | A * | 12/1969 | Goldstein | 106/2 |
| 6,437,070 | B1 * | 8/2002 | Parker et al. | 526/325 |
| 6,656,653 | B2 * | 12/2003 | Mitsuhashi et al. | 430/108.23 |
| 2005/0065242 | A1 * | 3/2005 | McGee et al. | 523/402 |

FOREIGN PATENT DOCUMENTS

| | | | | |
|---|---|---|---|---|
| CN | 103572603 | * | 10/2013 | C08F 2/30 |

OTHER PUBLICATIONS

English language translation of CN-103572603, translation generated May 2015, 4 pages.*

* cited by examiner

*Primary Examiner* — Robert S Loewe
(74) *Attorney, Agent, or Firm* — Birch, Stewart, Kolasch & Birch, LLP

(57) ABSTRACT

The present invention provides a preparation method for a fluorine-free water repellent, comprising (A) a homogenization step in which the raw materials are mixed in single step to obtain a mixture; and (B) a polymerization step to react said mixture into said water repellent. The operation of the present method is simple, and the water repellent produced has the advantage of high stability and high washing durability.

11 Claims, No Drawings

FLUORINE-FREE WATER REPELLENT, PREPARATION THEREOF, AND APPLICATIONS THEREOF

BACKGROUND

1. Technical Field

The present invention is related to a fluorine-free water repellent; especially to an improved preparation process for the fluorine-free water repellent.

2. Description of Related Art

Textile Repellents have existed in the industry for a long history. In 1950, E. I. du Pont de Nemours firstly applied polytetrafluoroethylene emulsion in textile for water repellence and oil repellence. Several years after that, 3M Company successfully developed a fluorine-containing water repellent named "Scotchgard" and since then, the era of using fluorine monomer-containing water repellents began. However, fluorine-containing water repellents have environmental hazards and carcinogenic risks and therefore do not comply with the requirements of environmental protection. Moreover, the fluorine-containing water repellents also have a relatively expensive price. Therefore, fluorine-free water repellents of using organic dendrimers, polyurethane, wax mixture, organic silicon, inorganic-organic mixing materials, or nano-metal-particle mixing materials as the main component had been launched. Unfortunately, among them, only the dendrimers, inorganic-organic mixing materials, or nano-metal-particle mixing materials types of them exhibited promised water-repellent effect.

Nevertheless, the preparation of dendrimers, inorganic-organic mixing materials, or nano-metal-particle mixing materials requires complicated process and strict reaction conditions as well as particular grinding and dispersing technology. Therefore, the price of the aforesaid water repellents remains at high level. In addition, the dispersion of hydrophobic polymers and inorganic materials in water is bad and the storage stability thereof is also problematic. Accordingly, the conventional fluorine-free water repellents are not ideal.

To sum up, both of the conventional fluorine-containing water repellents or fluorine-free water repellents have drawbacks that make them not ideal for the market; therefore, it is continuously a need for an environmental-friendly, low cost, and high quality water repellent.

SUMMARY

In light of the foregoing, one of the objects of the present invention is to provide a fluorine-free water repellent having the advantages of environmental-friendly and low biotoxicity.

Another object of the present invention is to provide a fluorine-free water repellent, which is prepared by an improved process for enhancing the stability thereof and reducing the preparation cost.

In order to achieve the aforesaid objects, a method for preparing a fluorine-free water repellent, comprising the following steps: (A) obtaining a mixture comprising: 5.0 to 20.0 parts by weight of a wax; 5.0 to 10.0 parts by weight of an unsaturated monomer; 3.0 to 6.0 parts by weight of a solvent; 60.0 to 75.0 parts by weight of water; and 1.0 to 4.0 parts by weight of an emulsifier; and (B) adding 0.1 to 0.5 parts by weight of an initiator to said mixture to obtain said water repellent.

Preferably, said step (A) comprises homogenizing said mixture at a temperature of 50 to 95° C.

Preferably, said homogenization is conducted at a pressure of 100 to 600 Kgf/cm$^2$.

Preferably, said homogenization is conducted for 0.1 to 5.0 hours.

Preferably, said step (B) is performed at a temperature of 50 to 90° C.

Preferably, said step (B) is performed at a pressure of 0.5 to 2.0 Kgf/cm$^2$.

Preferably, said step (B) comprises introducing nitrogen into the reaction.

Preferably, said wax has a melting point of 45 to 90° C.

Preferably, said wax is a petrochemical wax, a natural wax, a paraffin wax, an artificial wax, or a combination thereof.

Preferably, said unsaturated monomer is a $C_6$-$C_{50}$ carbon chain having an unsaturated functional group and/or a $C_6$-$C_{50}$ aromatic having an unsaturated functional group; wherein said unsaturated functional group comprises acrylic group, methacrylic group, vinyl group, or a combination thereof. Alternatively, said unsaturated monomer of $C_6$-$C_{50}$ can be substituted or unsubstituted.

Preferably, the aforesaid substituted or unsubstituted $C_6$-$C_{50}$ unsaturated monomer is: phenylethylene, stearyl acrylate, propyl acrylate, propyl methacrylate, glycidyl methacrylate, glycidyl acrylate, hydroxyethyl methacrylate, Hydroxyethyl acrylate, 3-Chloro-2-hydroxypropyl methacrylate, N-methylolacrylamide, N-(hydroxy)acrylamide, or a combination thereof.

Preferably, said solvent has a boiling point of 50 to 250° C. Preferably, said solvent is propylene glycol, dipropylene glycol methyl ether, 4-oxa-2,6-heptandiol, acetone, or a combination thereof.

Preferably, said emulsifier is a cationic emulsifier, an anionic emulsifier, a non-ionic emulsifier, or a combination thereof. Preferably, said emulsifier is octadearyl dimethyl ammonium chloride, stearyl alcohol polyoxyethylene, lauryl alcohol polyoxyethylene, oleyl alcohol polyoxyethylene, or a combination thereof.

Preferably, said initiator is a thermal initiator. Preferably, said thermal initiator has an initiation temperature of 30 to 90° C. Preferably, said thermal initiator is 2,2'-Azobis(2,4-dimethylvaleronitrile), benzoperoxide, 2,2'-Azodiisobutyramidine Dihydrochloride (V50), or a combination thereof.

Preferably, said mixture of said step (A) further comprises 2.0 to 5.0 parts by weight of a vinyl-terminated polydialkylsiloxane.

Preferably, said vinyl-terminated polydialkylsiloxane is vinyl-terminated polydimethylsiloxane. Preferably, said vinyl-terminated polydialkylsiloxane has a molecular weight of 400 to 4000.

Preferably, said method has a conversion rate of at least 97%.

Preferably, during the process of said method, a cooling step is conducted when a conversion rate in said step (B) reaches at least 97%. Preferably, when a temperature of said step (B) is lowered to 45° C., said method further comprises a filtering step to filter said water repellent.

Preferably, said method substantially does not use a fluorine-containing component.

The present invention also provides a water repellent made by the aforesaid method; wherein said water repellent substantially has no precipitation after being stored for at least 180 days.

The present invention also provides a method for modifying an object, comprising coating a layer of said water repellent on a surface of said object; and heating said object.

Preferably, said water repellent is mixed with a diluent to form a working solution before being used.

Preferably, said working solution comprises 10 to 150 g/L of said water repellent based on the total volume of said diluent. Preferably, said diluent is water.

Preferably, said working solution comprises 2 to 30 g/L of a binder based on the total volume of said diluent.

Preferably, said heating is to heat said object coated with said water repellent at a temperature of at least 120° C. for at least 90 seconds.

Preferably, said heating comprises a first step and a second step; said first step is to heat said object coated with said water repellent at a temperature of 120 to 140° C. for 110 to 130 seconds; and said second step is to heat said object coated with said water repellent at a temperature of 150 to 170° C. for 80 to 100 seconds.

The present invention also provides a modified object; wherein said object is coated with said water repellent on a surface thereof.

Preferably, said object is a texture, a leather, or a paper.

To sum up, the present invention is related to a method of preparing a fluorine-free water repellent. The water repellent prepared by the present method not only has the advantage of substantially having no fluorine-containing components but also has the property of high stability. The present invention provides the field with a novel choice of water repellent that is more in line with the demand of the industry.

DETAILED DESCRIPTION

The present invention is related to a fluorine-free water repellent. In order to better appreciate the drawbacks of the conventional fluorine-free water repellents, such as, complexity in preparation, expensive, and bad stability, the present invention provides a preparation method that is easy in operation and the water repellent prepared by the method exhibits superior stability. The method of the present invention can be separated into two parts: (A) a homogenization step; and (B) a polymerization step.

(A) Homogenization

The raw materials are mixed with each other in a single step during the homogenization step. Said "homogenization" "homogenize" or "homogenizing" means all the raw materials are mixed well to obtain a mixture with every raw material being evenly distributed in the obtained mixture. Said "in a single step" means the subsequent polymerization is conducted with all raw materials mixing together. In other words, the mixing and polymerization of the raw materials in the present method are not conducted separately in several stages but conducted as a whole.

In a preferable embodiment of the present invention, said mixture comprises the following components: 5.0 to 20.0 parts by weight of a wax; 5.0 to 10.0 parts by weight of an unsaturated monomer; 3.0 to 6.0 parts by weight of a solvent; 60.0 to 75.0 parts by weight of water; and 1.0 to 4.0 parts by weight of an emulsifier.

In a preferable embodiment of the present invention, said mixture comprises the following components: 10.0 to 18.0 parts by weight of a wax; 5.0 to 10.0 parts by weight of an unsaturated monomer; 3.0 to 6.0 parts by weight of a solvent; 60.0 to 75.0 parts by weight of water; 1.0 to 4.0 parts by weight of an emulsifier; and 2.0 to 5.0 parts by weight of a vinyl-terminated polydialkylsiloxane.

Based on the disclosure of the present invention, those having ordinary skill in the art shall be able to conduct the mixing of the materials at any desired temperature or pressure. Preferably, the homogenization of the materials is conducted at 50 to 95° C. to obtain the mixture. More specifically, the homogenization of the materials is conducted at 50 to 95° C. and 100 to 600 Kgf/cm$^2$ for 0.1 to 5.0 hours to obtain the mixture.

In a preferable embodiment, a wax having a melting point of 45 to 90° C. is chosen, including, without limitation: a petrochemical wax, a natural wax, a paraffin wax, an artificial wax, or a combination thereof. Said petrochemical wax includes, without limitation: paraffin wax. In a preferable embodiment, said unsaturated monomer is: a $C_6$-$C_{50}$ carbon chain having an unsaturated functional group and/or a $C_6$-$C_{50}$ aromatic having an unsaturated functional group; said unsaturated functional group comprises acrylic group, methacrylic group, vinyl group, or a combination thereof. Said carbon chain may be a branched or unbranched carbon chain. In alternative embodiment, said unsaturated monomer of $C_6$-$C_{50}$ may be substituted or unsubstituted.

For instance, the aforesaid substituted or unsubstituted $C_6$-$C_{50}$ unsaturated monomer may be phenylethylene, stearyl acrylate, propyl acrylate, propyl methacrylate, glycidyl methacrylate, glycidyl acrylate, hydroxyethyl methacrylate, Hydroxyethyl acrylate, 3-Chloro-2-hydroxypropyl methacrylate, N-methylolacrylamide, N-(hydroxy)acrylamide, or a combination thereof.

In a preferable embodiment, said solvent has a boiling point of 50 to 200° C. Said solvent may be, without limitation: propylene glycol, dipropylene glycol methyl ether, 4-Oxa-2, 6-heptandiol, acetone, or a combination thereof. Preferably, said emulsifier is a cationic emulsifier, an anionic emulsifier, a non-ionic emulsifier, or a combination thereof. Preferably, said emulsifier is: octadearyl dimethyl ammonium chloride, stearyl alcohol polyoxyethylene, lauryl alcohol polyoxyethylene, oleyl alcohol polyoxyethylene, or a combination thereof. Preferably, said vinyl-terminated polydialkylsiloxane is: vinyl-terminated polydimethylsiloxane. Preferably, said vinyl-terminated polydialkylsiloxane has a molecular weight of 400 to 4000.

(B) Polymerization

After the aforesaid homogenization is completed and a homogenized mixture is obtained, the mixture is moved to the polymerization step of the present method. In this step, the polymerization of the materials is initiated by adding an initiator. More specifically, 0.1 to 0.5 parts by weight of an initiator is added to said mixture in the polymerization step to obtain the present water repellent.

Those having ordinary skill in the art can choice any suitable initiator based on their needs. In a preferable embodiment, said initiator is a thermal initiator. Preferably, said thermal initiator has an initiation temperature of 30 to 90° C. Preferably, said thermal initiator is 2,2'-Azobis(2,4-dimethylvaleronitrile), benzoperoxide, 2,2'-Azodiisobutyramidine Dihydrochloride (V50), or a combination thereof.

In a preferable embodiment, said polymerization is conducted at 50 to 90° C. More specifically, said polymerization is conducted at 50 to 90° C. and 0.5 to 2.0 Kgf/cm$^2$. Preferably, the present method further comprises introducing nitrogen into the polymerization reaction.

In a preferable embodiment, said polymerization is continuously conducted until a conversion rate of the materials reaches at least 97%. In a preferable embodiment, a cooling step is conducted when said conversion rate reaches at least 97% for gradually reducing the temperature of the reaction. When the temperature of the reaction is reduced to 45° C., a filtering step is conducted to filter the obtained product (that is, the present fluorine-free water repellent).

In a preferable embodiment, the present invention substantially comprises no fluorine-containing component. Said "substantially comprises no fluorine-containing component" means there is no any fluorine-containing materials used in the present method and there is no need for a fluorine-containing component no matter what purpose is in the present invention. Nevertheless, those having ordinary skill in the chemical field can be appreciated that it is almost impossible to one hundred percent exclude the existence of a particular element or compound. The detection of the existence of a particular element or compound can at most be determined as "no detection" or "in an extremely low content". Furthermore, the limitation of "substantially comprises no fluorine-containing component" is to distinctly define that the present water repellent is a fluorine-free water repellent in comparison with the conventional fluorine-containing water repellent. Accordingly, the limitation of "substantially comprises no fluorine-containing component" to the present invention shall be clear and doubtless to those having ordinary skill in the art.

In another aspect of the present invention, the present invention provides a water repellent prepared by the aforesaid method. The water repellent prepared by the present invention is substantially free of fluorine-containing component and has superior stability. Said "substantially free of fluorine-containing component" is defined as set forth in the preceding paragraphs. A water repellent of bad stability tends to precipitate while storage; whereas, the present water repellent exhibits high stability as no precipitation generates after 180 days of storage. The superior stability results from a proper formulation of each material, which makes a micelle encapsulated by wax formed in the reaction. Consequently, the components with low water solubility can be evenly distributed in the water repellent, which therefore becomes a stable emulsion.

In another aspect of the present invention, the present invention provides a modification method of an object for providing at least one surface of said object with a water-repellent property. Said modification method comprises coating a water-repellent layer formed by the present water repellent on a surface of said object and then heating said object coated with said water-repellent layer.

In a preferable embodiment, said water repellent is mixed with a dilute to form a working solution. Said working solution comprises 10 to 150 g/L of said water repellent, which is based on the total volume of said dilute. Preferably, said dilute is water. In a preferable embodiment, said working solution further comprises 2 to 30 g/L of a binder, which is based on the total volume of said dilute.

Said working solution is applied to a surface of said object to form said water-repellent layer. Those having ordinary skill in the art can choose, based on their needs, any desired manner for forming said water-repellent layer. Case in point, said water-repellent layer can be formed by evenly spraying said working solution on a surface of said object; or by immersing said object into a bath of said working solution to evenly moisten a surface of said object with the working solution, and then pressing the surface by a roller to absorb the attached working solution to the surface.

In a preferable embodiment, said heating is to heat said object coated with said water repellent at a temperature of 120° C. for at least 90 seconds. More specifically, said heating comprises a first step and a second step; said first step is to heat said object coated with said water repellent at a temperature of 120 to 140° C. for 110 to 130 seconds; and said second step is to heat said object coated with said water repellent at a temperature of 150 to 170° C. for 80 to 100 seconds.

In another aspect of the present invention, the present invention provides a modified object; wherein a surface of said object is coated with said water repellent. More specifically, at least one surface of said object is coated with a water-repellent layer formed by said water repellent. The method for forming said water-repellent layer comprises using said water repellent as set forth in the preceding paragraphs.

In an alternative embodiment, said object is a texture, for example, without limitation: a texture of polyester, nylon, or a combination thereof. In another alternative embodiment, said object is a leather, for example, without limitation: cattle hide, sheepskin, or a combination thereof. In another alternative embodiment, said object is a paper.

The following embodiments recited the experiments and trials during the development of the present invention for further clarifying the features and advantages of the present invention. It shall be appreciated that the listing embodiments are only exemplary and shall not limit the claim scope of the present invention.

Example 1

The Preparation of the Present Water Repellent

Several samples of the present water repellent were prepared according to the present method and were tested for their water-repellent effect in the subsequent examples. Materials were mixed in accordance with the formulation listed in the Table 1 and stirred at 70° C. and 200 Kgf/cm$^2$ for 0.5 hours for homogenization. Then, an initiator (2,2'-Azodiisobutyramidine Dihydrochloride (V50)) was added, nitrogen was introduced and the stirring was performed at 70° C. and 200 Kgf/cm$^2$ for another 7.0 hours. After detecting the solid content in the reaction and confirming the conversion rate had reached 97%, the temperature of the reaction was gradually reduced to 45° C. and the product in the reaction was filtered by a gravity filtration.

TABLE 1

The Formulation of the Materials for Preparing the Samples of Water Repellent on Embodiments 1

| | A. homogenization | | | | | | |
|---|---|---|---|---|---|---|---|
| Sample | wax paraffin | unsaturated monomer phenylethylene; stearyl acrylate | solvent propylene glycol | water deionized water | emulsifier octadearyl dimethyl ammonium chloride, and stearyl alcohol polyoxyethylene | vinyl-terminated polydialkylsiloxane vinyl-terminated polydimethylsiloxane | B. Polymerization initiator 2,2'-Azodiisobutyramidine Dihydrochloride |
| 1 | 17.0 parts | 1.5 parts; 6.5 parts | 4.5 parts | 68.0 parts | 2.2 parts in total | none | 0.3 parts |
| 2 | 12.0 parts | 1.5 parts; 5.0 parts | 4.5 parts | 68.0 parts | 2.2 parts in total | 6.5 parts | 0.3 parts |

TABLE 1-continued

The Formulation of the Materials for Preparing the Samples of Water Repellent on Embodiments 1

| | A. homogenization | | | | | | |
|---|---|---|---|---|---|---|---|
| Sample | wax paraffin | unsaturated monomer phenylethylene; stearyl acrylate | solvent propylene glycol | water deionized water | emulsifier octadearyl dimethyl ammonium chloride, and stearyl alcohol polyoxyethylene | vinyl-terminated polydialkylsiloxane vinyl-terminated polydimethylsiloxane | B. Polymerization initiator 2,2'-Azodiisobutyramidine Dihydrochloride |
| 3 | 12.0 parts | 1.5 parts; 5.0 parts; and propyl methacrylat 3.0 parts; | 4.5 parts | 65.0 parts | 2.2 parts in total | 6.5 parts | 0.3 parts |
| 4 | 12.0 parts | 1.5 parts; 5.0 parts; and propyl methacrylate 3.0 parts | 4.5 parts | 60.0 parts | 2.2 parts in total | 6.5 parts | 0.3 parts |

Note:
parts, i.e. parts by weight.

Example 2

Tests to the Present Water Repellent

In this example, the samples prepared in the Example 1 were tested for their effects in water repellency. The aforesaid samples were prepared as working solutions in accordance with the following Table 2. Next, textiles of polyester and nylon were immersed into said working solutions respectively and pressed to absorb said working solutions on the surface of said textiles. After that, the textiles were heated at 130° C. for 120 seconds and subsequently heated again at 160° C. for 90 seconds.

TABLE 2

Working Solutions in Example 2

| Working Solution | Sample | Binder |
|---|---|---|
| 1A | Sample 1; 60 g/L | None |
| 1B | Sample 1; 60 g/L | JintexEco FCD; 20 g/L |
| 2A | Sample 2; 60 g/L | None |
| 2B | Sample 2; 60 g/L | JintexEco FCD; 20 g/L |
| 3A | Sample 3; 60 g/L | None |
| 3B | Sample 3; 60 g/L | JintexEco FCD; 20 g/L |
| 4A | Sample 4; 60 g/L | None |

TABLE 2-continued

Working Solutions in Example 2

| Working Solution | Sample | Binder |
|---|---|---|
| 4B | Commercial water repellent x; 60 g/L | None |
| 4C | Commercial water repellent y; 60 g/L | None |

Note 1:
All the samples listed above used water as the diluents.
Note 2:
The concentration unit "g/L" is based on the total volume of the diluents.
Note 3:
Working solutions 4B and 4C are comparative samples, which are commercial water repellent x and commercial water repellent y, respectively.
Note 4:
Commercial water repellent x uses silicon as the main component.
Note 5:
Commercial water repellent y uses wax as the main component.

The water repellency effect of the polyester and nylon textiles coated with the present water repellent (working solution) was tested by following the rule of AATCC-22. The water repellency effect was also tested after the textiles were washed 5 times or 10 times to evaluate the washing durability of the present water repellent. The results were listed in the Table 3.

TABLE 3

Results of the Tests for Water Repellency

| Working | Polyester Textile | | | Nylon Textile | | |
|---|---|---|---|---|---|---|
| Solution | Washed × 0 | Washed × 5 | Washed × 10 | Washed × 0 | Washed × 5 | Washed × 10 |
| 1A | 90 | 80 | n/a | 70 | 70 | n/a |
| 1B | 90 | 80 | n/a | 80 | 70 | n/a |
| 2A | 90 | $80^{+}$ | n/a | $80^{+}$ | $80^{-}$ | n/a |
| 2B | 90 | 90 | n/a | $80^{+}$ | 80 | n/a |
| 3A | $90^{+}$ | 90 | n/a | $80^{+}$ | $80^{+}$ | n/a |
| 3B | $90^{+}$ | 90 | n/a | $80^{+}$ | $80^{+}$ | n/a |
| 4A | 100 | $90^{+}$ | $90^{+}$ | $90^{+}$ | $90^{+}$ | 90 |
| 4B | 100 | 90 | $90^{-}$ | 90 | $90^{-}$ | 80 |
| 4C | 90 | $90^{-}$ | $80^{+}$ | 90 | $80^{+}$ | 80 |

According to the data shown in Table 3, the water repellent of the present invention was able to provide superior water repellency for the textiles. Moreover, the water repellency can be maintained even after 5 times or 10 times of washing. It was also noted that the present invention exhibited comparable water repellency with that of the commercial products. By taking other advantages of the present invention into consideration, such as higher stability, the present water repellent obviously is a better choice for the industry.

Example 3

Tests to the Present Water Repellent

The stability of the present water repellents were tested in this example. The present water repellents (the aforesaid Samples 1, 2, 3, and 4), the commercial water repellent x and the commercial water repellent y were filled in a transparent container, respectively and stored at room temperature (25° C.) or 60° C. After being stored for 30 days, 60 days, 90 days and 180 days, the bottom and the wall of the container as well as the interface of the liquid and the air in the container were observed by naked eye to determine if there was any precipitation generated. The data was recorded in the Table 4.

TABLE 4

| Records of Stability Tests | | | | | |
|---|---|---|---|---|---|
| | Day 0 | Day 30 | Day 60 | Day 90 | Day 180 |
| 25° C. | | | | | |
| Commercial water repellent x | ○ | ○ | X | X | X |
| Commercial water repellent y | ○ | ○ | X | X | X |
| Sample 1 | ○ | ○ | ○ | ○ | ○ |
| Sample 2 | ○ | ○ | ○ | ○ | ○ |
| Sample 3 | ○ | ○ | ○ | ○ | ○ |
| Sample 4 | ○ | ○ | ○ | ○ | ○ |
| 60° C. | | | | | |
| Commercial water repellent x | ○ | X | X | X | X |
| Commercial water repellent y | ○ | X | X | X | X |
| Sample 1 | ○ | ○ | ○ | ○ | ○ |
| Sample 2 | ○ | ○ | ○ | ○ | ○ |
| Sample 3 | ○ | ○ | ○ | ○ | ○ |
| Sample 4 | ○ | ○ | ○ | ○ | ○ |

Note:
"○" means the stability test was passed; i.e. no precipitation generated.
"X" means the stability test was failed; i.e. precipitation generated.

The data in Table 4 showed that the present water repellents were free from precipitation after 3-month storage no matter at room temperature or at 60° C. The present water repellents exhibited a high level of stability and were favorable for long term storage.

Those having ordinary skill in the art shall be appreciated various modification to the embodiments recited in the specification without being contrary to the spirit of the present invention. It shall be obvious that the aforesaid embodiments do not intend to limit the present invention but to cover the possible modifications under the spirit and scope of the present invention as defined by the claims.

What is claimed is:

1. A method for preparing a fluorine-free water repellent, comprising the following steps:

(A) obtaining a mixture comprising:
5.0 to 20.0 parts by weight of a wax;
5.0 to 10.0 parts by weight of an unsaturated monomer;
3.0 to 6.0 parts by weight of a solvent;
60.0 to 75.0 parts by weight of water; and
1.0 to 4.0 parts by weight of an emulsifier; and (B) adding 0.1 to 0.5 parts by weight of an initiator to said mixture to obtain said water repellent.

2. The method of claim 1, wherein said step (A) comprises homogenizing said mixture at a temperature of 50 to 95° C. and a pressure of 100 to 600 Kgf/cm$^2$.

3. The method of claim 1, wherein said step (B) is performed at a temperature of 50 to 90° C. and a pressure of 0.5 to 2.0 Kgf/cm$^2$.

4. The method of claim 1, wherein said wax has a melting point of 45 to 90° C.

5. The method of claim 1, wherein said unsaturated monomer is a $C_6$-$C_{50}$ carbon chain having an unsaturated functional group and/or a $C_6$-$C_{50}$ aromatic having an unsaturated functional group; wherein said unsaturated functional group comprises acrylic group, methacrylic group, vinyl group, or a combination thereof.

6. The method of claim 1, wherein said solvent is propylene glycol, dipropylene glycol methyl ether, 4-oxa-2,6-heptandiol, acetone, or a combination thereof.

7. The method of claim 1, wherein said emulsifier is a cationic emulsifier, an anionic emulsifier, a non-ionic emulsifier, or a combination thereof.

8. The method of claim 1, wherein said initiator is a thermal initiator having an initiation temperature of 30 to 90° C.

9. The method of claim 1, wherein said mixture of said step (A) further comprises 2.0 to 5.0 parts by weight of a vinyl-terminated polydialkylsiloxane.

10. The method of claim 9, wherein said vinyl-terminated polydialkylsiloxane is vinyl-terminated polydimethylsiloxane.

11. The method of claim 9, wherein said vinyl-terminated polydialkylsiloxane has a molecular weight of 400 to 4000.

* * * * *